US011034008B2

(12) United States Patent
Hile

(10) Patent No.: US 11,034,008 B2
(45) Date of Patent: Jun. 15, 2021

(54) NAIL PULLER

(71) Applicant: Jeffrey B. Hile, Wexford, PA (US)

(72) Inventor: Jeffrey B. Hile, Wexford, PA (US)

(73) Assignee: JBH INNOVATIONS, INC., Wexford, PA (US)

( * ) Notice: Subject to any disclaimer, the term of this patent is extended or adjusted under 35 U.S.C. 154(b) by 131 days.

(21) Appl. No.: 16/596,894

(22) Filed: Oct. 9, 2019

(65) Prior Publication Data

US 2020/0368889 A1 Nov. 26, 2020

Related U.S. Application Data

(60) Provisional application No. 62/850,640, filed on May 21, 2019.

(51) Int. Cl.
*B25B 27/00* (2006.01)
*B25C 11/00* (2006.01)

(52) U.S. Cl.
CPC ..... *B25C 11/00* (2013.01)

(58) Field of Classification Search
CPC ..... B25B 19/00; B25C 11/00; B25C 5/00; B25C 1/00
See application file for complete search history.

(56) References Cited

U.S. PATENT DOCUMENTS

| | | | | |
|---|---|---|---|---|
| 949,337 | A * | 2/1910 | Trogner | B25C 11/00 254/25 |
| 4,997,163 | A | 3/1991 | Henning | |
| 6,105,935 | A * | 8/2000 | Wagner | B25C 11/00 254/21 |
| 7,673,848 | B1 * | 3/2010 | Provines | B25C 11/00 254/25 |
| 2005/0062025 | A1 | 3/2005 | Forrester | |
| 2006/0108570 | A1 * | 5/2006 | Del Favero | B66F 15/00 254/131 |
| 2020/0368889 | A1 * | 11/2020 | Hile | B25C 11/00 |

* cited by examiner

*Primary Examiner* — Lee D Wilson
(74) *Attorney, Agent, or Firm* — Carothers & Carothers

(57) ABSTRACT

A nail puller having a lever arm assembly with an arcuate gripping jaw plate secured to a bottom end, and a base assembly pivotally secured to the bottom portion of the lever arm assembly, the base assembly includes an arcuate rocker base plate pivotally secured to a bottom portion of the lever arm assembly for concentric pivotal movement relative to the arcuate gripping jaw plate of the lever arm assembly. The arcuate gripping jaw plate of the lever arm assembly and the arcuate rocker base plate of the base assembly are provided with transverse open-ended slots for simultaneously receiving the shank of a nail to be extracted. The nail shank received within the slots is gripped and leveraged out by rotating the upper lever arm assembly in either a clockwise or counterclockwise direction.

3 Claims, 4 Drawing Sheets

NAIL PULLER

CROSS REFERENCE

This application claims the benefit of U.S. Provisional Patent Application No. 62/850,640, filed on May 21, 2019, for NAIL PULLER.

BACKGROUND OF THE INVENTION

The present invention pertains to hand tools, and more particularly to apparatus for pulling nails.

Various tools have been developed to pull nails from boards and other materials. For example, claw hammers and claw bars are well known. Other nail pulling devices have been developed wherein the foot and handle of the device are pivotable relative to each other for thereby providing a jaw which is closed by rotating the handle above the foot to grip a nail shank therebetween. For example, see U.S. Pat. Nos. 4,997,163 and 6,105,935, and US Patent Application Publication No. 2005/0062025.

SUMMARY OF THE INVENTION

The present invention pertains to an improvement of these afore-described nail pullers. The nail puller of the present invention includes a lever arm assembly having a lever arm with a handle portion at an upper end thereof and an arcuate gripping jaw plate secured to a bottom end of the lever arm. A concave upper face of this arcuate gripping jaw plate faces upwardly toward the lever arm, and an open end gripping slot is centrally located in the arcuate gripping jaw plate. This gripping slot extends transversely to the concave face of the arcuate gripping jaw plate.

A base assembly is pivotally secured to a bottom portion of the lever arm and is provided with an arcuate rocker base plate with an upwardly extending pivot arm pivotally secured to the bottom portion of the lever arm. The arcuate rocker base plate is positioned below and directly adjacent the arcuate gripping jaw plate and has an upwardly exposed arcuate face that generally reflects an arcuate bottom surface of the arcuate gripping jaw plate whereby the arcuate rocker base plate is pivotally movable concentrically relative to the arcuate gripping jaw plate. The arcuate rocker base plate also has an open end slot therein which is transverse to the upwardly exposed arcuate face, and this rocker base plate slot is positioned to be aligned with the aforesaid gripping slot of the arcuate gripping jaw plate, with the open ends of these slots aligned with each other, when the lever arm is held in a generally upright or vertical position. This mechanism permits an exposed nail shank to be passed into these aligned slots simultaneously through the open ends thereof, or alternately through the slots themselves, for removal of the nail by rotating the lever arm with the handle to thereby pinch the nail shank between the respective slots and leverage the nail upward by rocking a bottom surface of the arcuate rocker base plate on a surface in which the nail is embedded.

The nail puller of the present invention provides a nail puller which is more readily and more easily securable to the nail to be removed than the nail pullers of the prior art, and in addition, provides the convenience of being able to remove the secured nail by rocking the nail puller in either a left hand or a right hand direction as desired. In addition, as the nail puller of the present invention is being rocked in either a clockwise or counterclockwise direction, the gripping pressure of the nail puller on the nail being removed proportionately increases with the rocking rotation of the lever arm.

A nail claw may be secured to an upper end of the lever arm for conventionally raising imbedded nail heads to a level wherein the nail shank may be accessed for gripping by the nail puller.

BRIEF DESCRIPTION OF THE DRAWINGS

Other objects and advantages appear hereinafter in the following description and the appended claims. The appended drawings show, for the purpose of exemplification, without limiting the scope of the present invention or the appended claims, certain practical embodiments of the present invention wherein:

DETAILED DESCRIPTION OF THE DRAWINGS

Figure 1A:
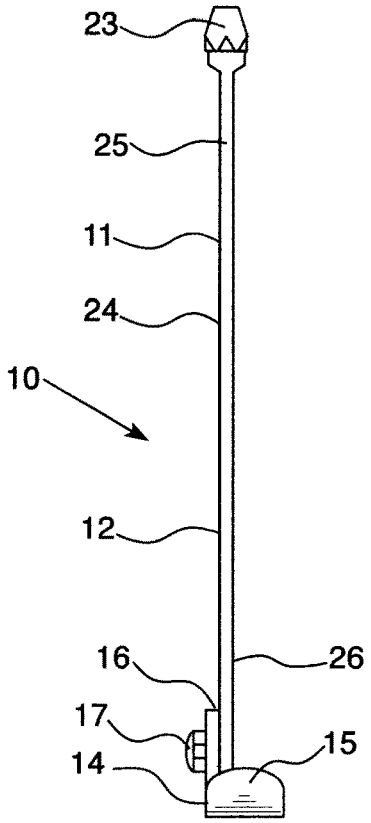
FIG. 1A is a left side view in elevation of the nail puller of the present invention.
Figure 1B:
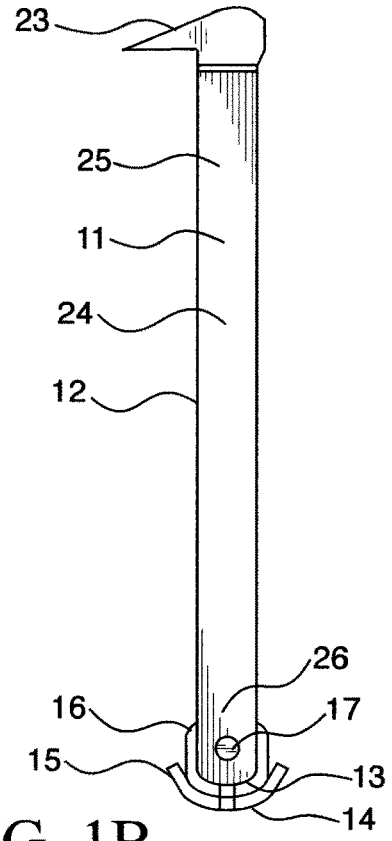
FIG. 1B is a view in front elevation of the nail puller shown in FIG. 1A.
Figure 1C:
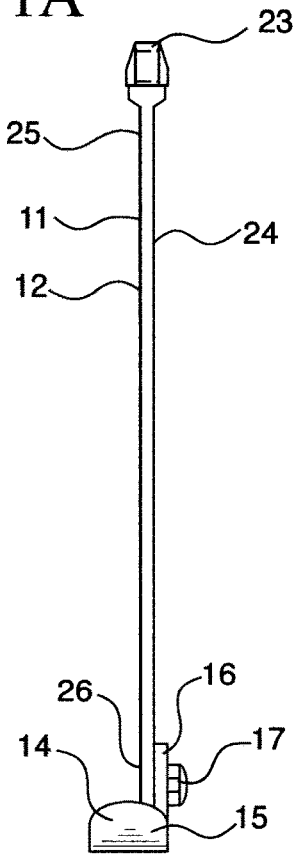
FIG. 1C is a view in right side elevation of the nail puller shown in FIG. 1B.
Figure 1D:
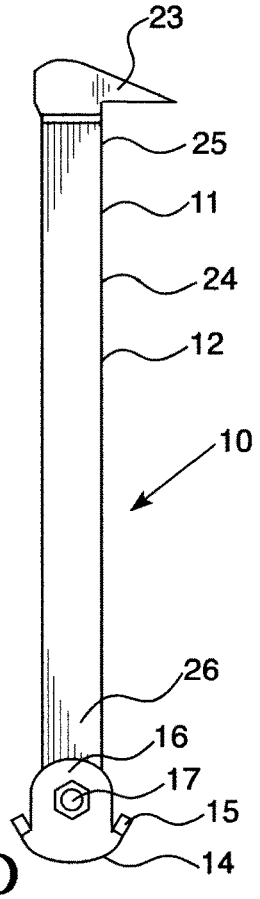
FIG. 1D is a view in rear elevation of the nail puller shown in FIG. 1B.
Figure 1E:
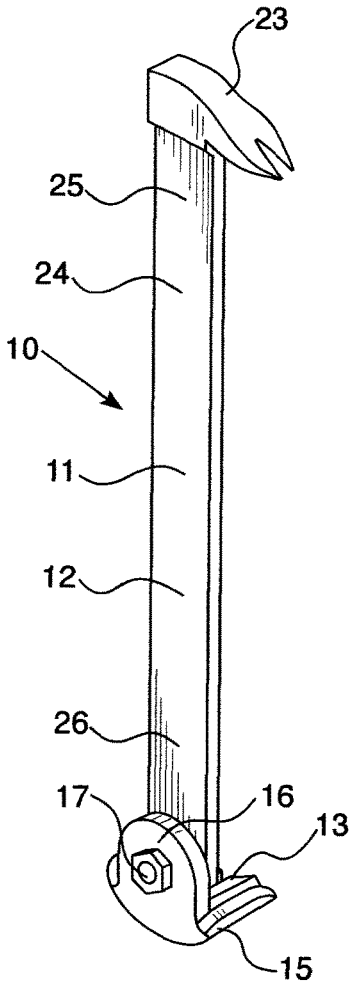
FIG. 1E is an isometric view in rear elevation of the nail puller shown in the previous figures.
Figure 1F:
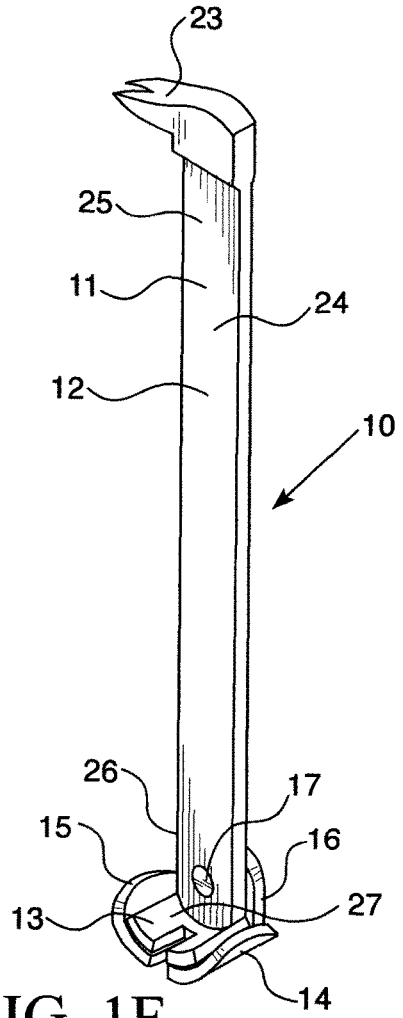
FIG. 1F is an isometric view in front elevation of the nail puller shown in the previous figures.
Figure 1G:
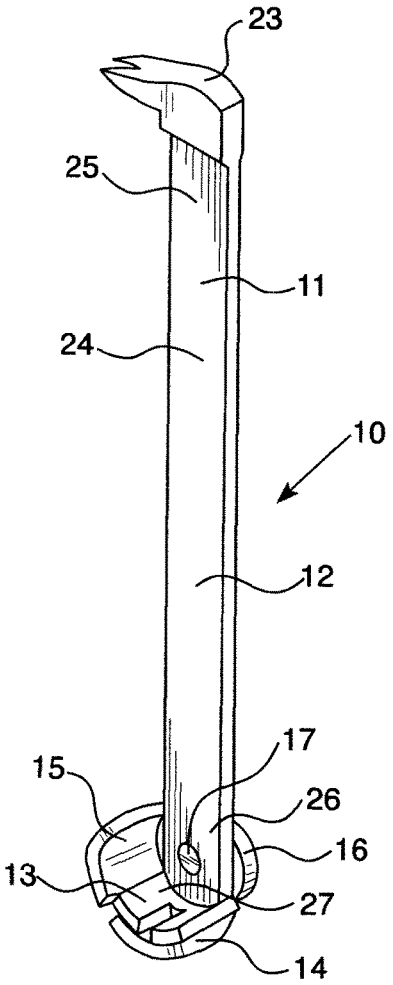
FIG. 1G is an isometric view in front elevation of the nail puller shown in the previous figures with the exception that the upper handle assembly portion is shown to be pivoted relative to the base assembly at the bottom foot portion of the device.
Figure 2A:
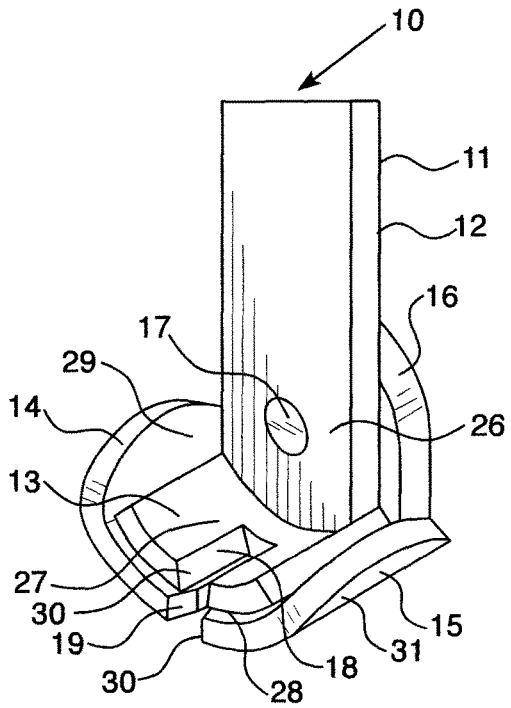
FIG. 2A is an enlarged view of the bottom portion of the nail puller shown in FIG. 1F.
Figure 2B:
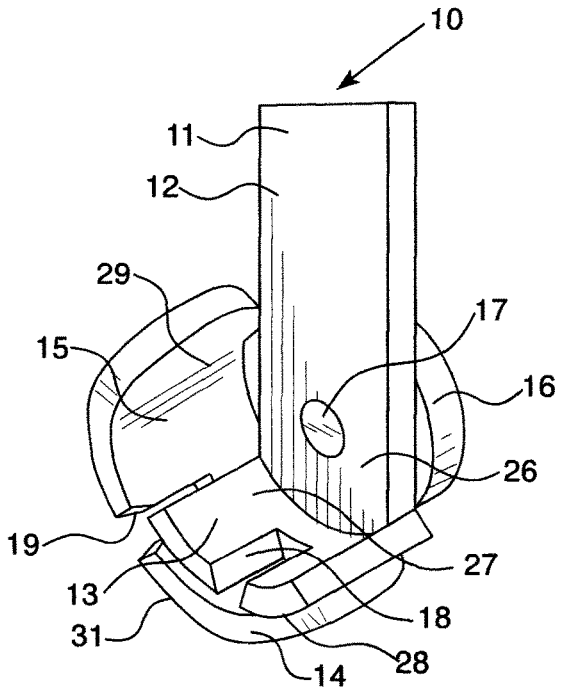
FIG. 2B is an enlarged view of the bottom portion of the nail puller as illustrated in FIG. 1G.
Figure 2C:
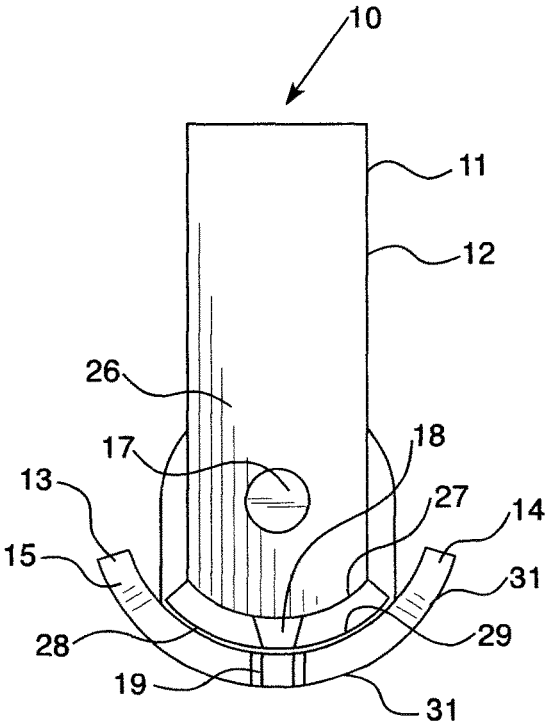
FIG. 2C is an enlarged view of the bottom portion of the nail puller as illustrated in FIG. 1B.
Figure 2D:
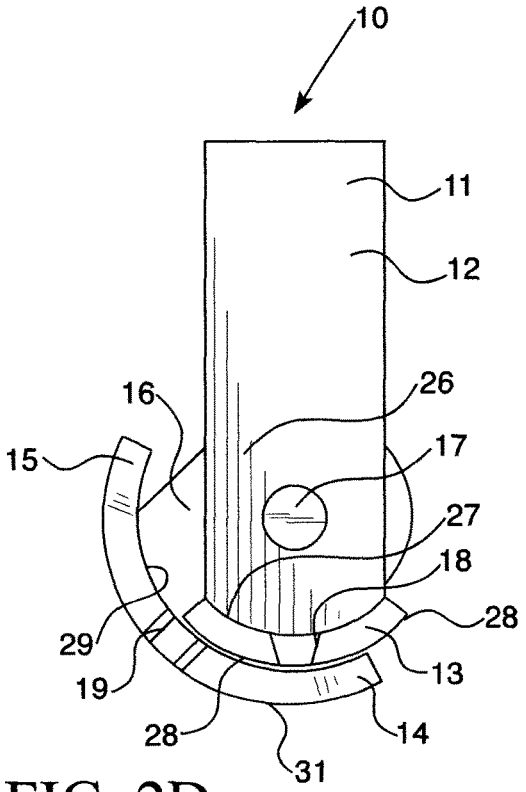
FIG. 2D is an enlarged view in front elevation of the bottom portion of the nail puller of the present invention shown in FIG. 1B.
Figure 3A:
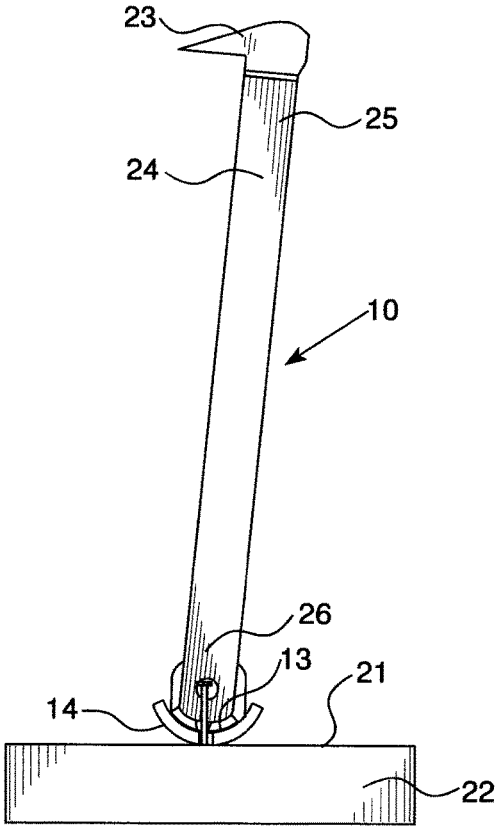
FIG. 3A is a view in front elevation illustrating the application of the nail puller of the present invention as being applied to a nail lodged in a board for initially grasping the nail shank with the nail puller of the present invention for removal from the board.
Figure 4A:
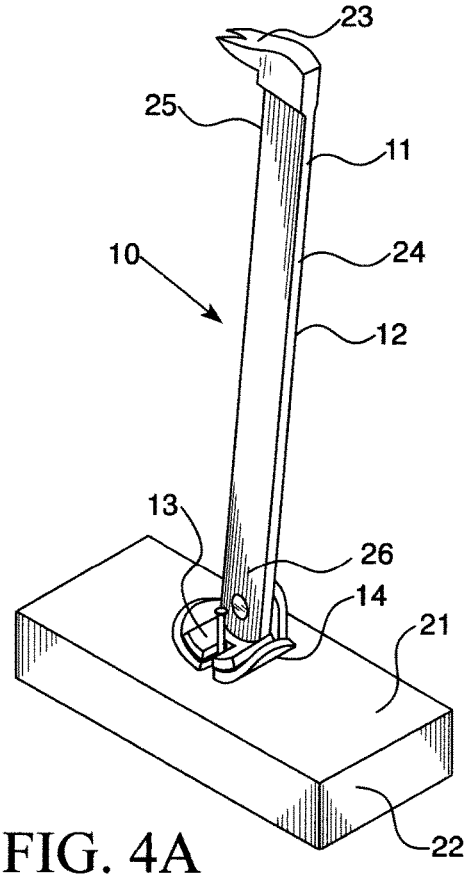
FIG. 4A is an isometric front view of the nail puller of the present invention as illustrated in FIG. 3A.
Figure 3B:
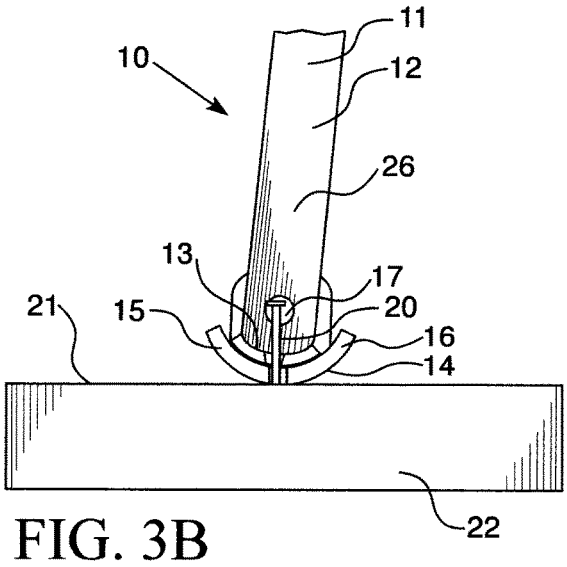
FIG. 3B is an enlarged view of the bottom portion of the combination illustrated in FIG. 3A.
Figure 4B:
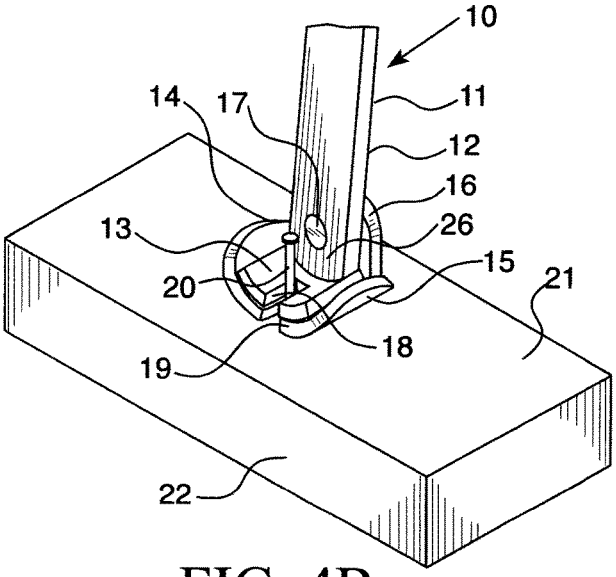
FIG. 4B is an isometric view of the configuration illustrated in FIG. 3B.

Referring to the drawings, the nail puller 10 consists of two primary parts which are in a pivotal relationship to each other, namely, the lever arm assembly 11, which includes the lever arm 12 and the arcuate gripping jaw plate 13, and the base assembly 14, which includes the arcuate rocker base plate 15 having an upwardly extending pivot arm 16. Base assembly 14 is pivotal relative to lever arm assembly 11 about pivot 17 as is best illustrated in FIGS. 1G, 2B and 2D.

Lever arm assembly 11 is provided with a handle portion 24 at an upper end 25 thereof and an arcuate gripping jaw plate 13 is secured to a bottom end 26 of the lever arm 12.

A concave upper face 27 of arcuate gripping jaw plate 13 faces upwardly towards lever arm 12 and an open end gripping slot 18 is centrally located in arcuate gripping jaw plate 13. Gripping slot 18 extends transversely to the concave upper face 27.

Base assembly 14 is pivotally secured to bottom portion 26 of lever arm 12 and is provided with an arcuate rocker base plate 15 which is secured to and depends from an upwardly extending pivot arm 16 that is pivotally secured to bottom portion 26 of lever arm 12. Arcuate rocker base plate 15 is positioned below and directly adjacent arcuate gripping jaw plate 13 and has an upwardly exposed arcuate face 29 that generally reflects the arcuate bottom surface 28 of arcuate gripping jaw plate 13. Arcuate rocker base plate 15 is pivotally movable concentrically about pivot 17 relative to arcuate gripping jaw plate 13. Arcuate rocker base plate 15 is also provided with an open end slot 19 therein which is transverse to the upwardly exposed arcuate face 27 and which is positioned to be aligned with gripping slot 18 of arcuate gripping jaw plate 13, with the open ends 30 aligned with each other, when lever arm 12 is held in a generally upright or vertical position as illustrated in FIGS. 1B, 2A, and 2C.

Accordingly, as is best illustrated in FIGS. 3A-4B, the exposed shank of nail 20 may be passed into aligned slots 18 and 19 simultaneously through the open ends 30 thererof for removal of the nail by rotating the lever arm 12 in either a clockwise or counterclockwise direction to thereby pinch the nail shank between slots 18 and 19 and thereby leverage the nail 20 upward by rocking the bottom surface 31 of arcuate rocker base plate 15 on a surface 21 in which nail 20 is embedded.

FIGS. 3A-4B illustrate the lever arm 12 being rotated to the right or in a clockwise direction in order to extract nail 20. However, if desired, the lever arm 12 may be just as easily rotated instead in a counterclockwise direction to the left in order to extract nail 20.

The upper end 25 of lever arm 12 is provided with a conventional nail claw 23 which may be initially utilized by hammering the claw 23 under a nail head which is recessed or embedded into the upper surface of a board in a conventional fashion to expose the nail head above the upper surface 21 of the board for further access to the shank of the nail for easy extraction utilizing the nail puller of the present invention as described.

The side edges of gripping slot 18 are tapered as shown to provide secure gripping of a nail shank.

I claim:

1. A nail puller comprising:

a lever arm assembly having a lever arm with a handle portion at an upper end thereof and an arcuate gripping jaw plate secured to a bottom end of said lever arm, a concave upper face of said arcuate gripping jaw plate facing upwardly toward said lever arm and an open end gripping slot centrally located in said arcuate gripping jaw plate, said gripping slot extending transversely to said concave face;

a base assembly pivotally secured to a bottom portion of said lever arm and having an arcuate rocker base plate with an upwardly extending pivot arm pivotally secured to said bottom portion of said lever arm, said arcuate rocker base plate positioned below and directly adjacent said arcuate gripping jaw plate and having an upwardly exposed arcuate face that generally reflects an arcuate bottom surface of said arcuate gripping jaw plate whereby said arcuate rocker base plate is pivotally movable concentrically relative to said arcuate gripping jaw plate, said arcuate rocker base plate having an open end slot therein which is transverse to said upwardly exposed arcuate face and which is positioned to be aligned with said gripping slot of said arcuate gripping jaw plate with the open ends of said slots aligned with each other when said lever arm is held in a generally vertical position, whereby an exposed nail shank may be passed into said aligned slots simultaneously through the open ends thereof for removal of the nail by rotating said lever arm to thereby pinch the nail shank between said slots and leverage the nail upward by rocking a bottom surface of said arcuate rocker base plate on a surface in which the nail is imbedded.

2. The nail puller of claim 1, including a nail claw secured to an upper end of said lever arm.

3. The nail puller of claim 1, wherein sides of said gripping slot are tapered to provide secure gripping of a nail shank.

* * * * *